US005474013A

United States Patent [19]

Wittmaier

[11] Patent Number: 5,474,013

[45] Date of Patent: Dec. 12, 1995

[54] TRIM TAB AUTO-RETRACT AND MULTIPLE SWITCHING DEVICE

[75] Inventor: Edward A. Wittmaier, St. Charles, Mo.

[73] Assignee: Trim Master Marine, Inc., St. Charles, Mo.

[21] Appl. No.: 406,758

[22] Filed: Mar. 17, 1995

Related U.S. Application Data

[63] Continuation of Ser. No. 27,037, Mar. 5, 1993, abandoned.

[51] Int. Cl.[6] ..... B63B 1/22

[52] U.S. Cl. ..... 114/286; 114/285

[58] Field of Search ..... 114/285, 286, 114/287; 440/86

[56] References Cited

U.S. PATENT DOCUMENTS

| | | | |
|---|---|---|---|
| Re. 34,285 | 6/1993 | Olson et al. | 440/1 |
| 2,386,803 | 10/1945 | Jutte . | |
| 2,966,876 | 1/1961 | MacWilliam . | |
| 3,062,167 | 11/1962 | Bennett . | |
| 3,111,113 | 11/1963 | Jaquith . | |
| 3,116,710 | 1/1964 | Cass . | |
| 3,160,836 | 12/1964 | Farley . | |
| 3,250,240 | 5/1966 | Ziegler . | |
| 3,298,334 | 1/1967 | Holmann . | |
| 3,376,842 | 4/1968 | Wynne . | |
| 3,399,643 | 9/1968 | Bennett . | |
| 3,404,651 | 10/1968 | Jensen et al. . | |
| 3,628,487 | 12/1971 | Bennett . | |
| 3,641,965 | 2/1972 | Schmierdel . | |
| 3,650,310 | 3/1972 | Childress . | |
| 3,654,549 | 4/1972 | Maurer et al. . | |
| 3,695,204 | 10/1972 | Bennett . | |
| 4,004,541 | 1/1977 | Onal . | |
| 4,086,869 | 5/1978 | Woodruff . | |
| 4,190,841 | 2/1980 | Harada . | |

(List continued on next page.)

FOREIGN PATENT DOCUMENTS

| | | | |
|---|---|---|---|
| 20290 | 1/1988 | Japan | 114/286 |

OTHER PUBLICATIONS

Electronic Tab Return, Insta Trim (no date).
Bennett Trimdicators, Bennett Marine (no date).
Trim To Perfection, Trim Master (no date).
Trimdraulic, Trim Master, (no date).
Automatic Tab Return, Trim Master, (no date).
Trim–A–Tron Installation Sheet, Trim Master, (no date).
Auto Tab Retractor, Bennett Marine, (no date).
Trim Master Trim Tabs, Trim Master, (no date).
Bennett Trim Tabs, Bennett Marine, 5a—Dec. 1986.
What Do Bennett Trim Tabs Do and Why Are They So Popular, Bennett Marine 14–Aug. 1987.
Bennett Trim Tabs and the Competition, Bennett Marine, 15—Aug. 1987.

(List continued on next page.)

*Primary Examiner*—Stephen Avila
*Attorney, Agent, or Firm*—Haverstock, Garrett & Roberts

[57] ABSTRACT

Electromechanical control circuit for causing trim tabs attached to the stern of a hull of a motorized marine vessel, and used to trim the attitude of the vessel, to be automatically fully retracted by activating means independently of the boat ignition switch to cause a capacitor in the circuit to discharge. The means can include at least one switch connected between the capacitor and an electrical power source to which the control circuit can be connected such that the means are activated when the switch is opened. The switch can be positioned at multiple locations throughout the boat or, alternatively, controls to cause the switch to open can be mounted to the boat at multiple locations throughout the craft, including at the main control panel. The means can also be in communication with boat engine gear shift controls such that the means are activated when the vessel engine is shifted into reverse gear. The control circuit further includes means for preventing damage to the circuit components if the circuit is improperly connected to the electrical power source.

27 Claims, 2 Drawing Sheets

U.S. PATENT DOCUMENTS

| | | | |
|---|---|---|---|
| 4,232,626 | 11/1980 | Kern . | |
| 4,261,278 | 4/1981 | Gaudin . | |
| 4,420,741 | 12/1983 | West | 114/285 |
| 4,644,662 | 2/1987 | Anderson et al. . | |
| 4,644,893 | 2/1987 | Zepp . | |
| 4,652,878 | 3/1987 | Borgersen . | |
| 4,742,794 | 5/1988 | Hagstrom . | |
| 4,762,079 | 8/1988 | Takeuchi et al. | 114/285 |
| 4,797,661 | 1/1989 | Wiley . | |
| 4,800,542 | 1/1989 | Franklin et al. . | |
| 4,811,491 | 3/1989 | Phillips et al. . | |
| 4,861,291 | 8/1989 | Koike . | |
| 4,872,857 | 10/1989 | Newman et al. . | |
| 4,899,133 | 2/1990 | Bartlett . | |
| 4,908,766 | 3/1990 | Takeuchi . | |
| 4,934,970 | 6/1990 | Lamprey . | |
| 5,058,520 | 10/1991 | Fahrney | 114/285 |
| 5,113,780 | 5/1992 | Bennett et al. | 114/286 |

OTHER PUBLICATIONS

Bennett Trim Tabs and Boats Under 24', Bennett Marine 16—Aug. 1987.
Trim Tabs & Power Trim The Potent Combination, Bennett Marine 17–Aug. 1987.
"Quick Connect" Installation Instructions, Bennett Marine 18–Nov. 1987.
Sport Tab Series, Bennett Marine, 19–Apr. 1988.
Sport Tab Installation Instructions, Bennett Marine, 21—Aug. 1988.
Bass Tab Series, Bennett Marine, 23—Sep. 1988.
Hatch Lifting System, Bennett Marine, 24—Sep. 1988.
Retail Parts Price List, Bennett Marine, 11—Oct. 1988.
Trim Tab Pricing & Ordering Instructions, Bennett Marine, 6—Oct. 1988.
Trimdicator Templates, Bennett Marine,26—Jan. 1989.
Bass Tab Installation Instructions, Bennett Marine 28—Feb. 1989.
International Marine Trades Exhibit & Convention, photo of display, sales meeting outline, Mar. 6, 1989.
Circuit Diagram, Schmatic, Board Layout, and Installation Instructions, Bennett Marine, May 10, 1989.
Bennett Trimdicator, Bennett Marine 9a—Jun. 1989.
1989 New Product Clip Art, Bennett Marine 31—Jul. 1989.
Trim Tabs Promotional Material Order Form, Bennett Marine, 20—Jul. 1989.
Trim Tabs Non–Standard Installation Options, Bennett Marine, 32–Jul. 1989.
New Product Announcement, Bennett Marine, Aug. 14, 1989.
The Auto Tab Retractor, Bennett Marine, 30—Aug. 1989.
Hatch Lifting System, Bennett Marine, 24—Aug. 1989.
Trim Tabs Owners Manual, Bennett Marine, 29—Aug. 1989.
How to Use Your Bennett Trim Tabs, Bennett Marine, 34—Oct. 1989.
Line Art Sport Tabs Series, Bennett Marine,22—Aug. 1992.
Lenco Trim Tab Retractor, L. Saraga, Inc., Feb. 25, 1993.
Owners Manual, Bennett Marine, 29B—Mar. 1993.
Dual Actuator Template, Bennett Marine, 25—May 1993.

TRIM TAB AUTO-RETRACT AND MULTIPLE SWITCHING DEVICE

This application is a Continuation of application Ser. No. 08/027,037, filed Mar. 5, 1993, now abandoned.

BACKGROUND OF THE INVENTION

1. Technical Field

The present invention relates to an automated trim tab control system for use on a motorized marine vessel and, more particularly, to an electro-mechanical circuit that will automatically cause the trim tabs to be fully retracted upon causing a capacitor in the circuit to discharge. The capacitor is caused to discharge by either opening a switch connected between the capacitor and the electrical power source, or by grounding a portion of the circuit by shifting the engine into reverse gear. The present invention also relates to a tab control system providing a plurality of control buttons wired to the switch, or alternatively a plurality of the switches, the control buttons or the switches being mounted in multiple locations throughout the craft, including at the vessel's main control panel, each button or switch being configured to facilitate operation by foot or by hand, depending upon its location.

2. Background Art

It is well known in the power boat manufacturing industry to employ devices on marine vessels to allow the operator to selectively trim the attitude of the craft to accommodate various conditions as the boat is powered through the water. One of the more common of these devices uses substantially planar tabs adjustably attached to the rear of the hull of the vessel below the water line. When the boat is propelled forward, the bow can be raised or lowered in relation to the stern by adjusting the orientation of the tabs accordingly.

While adjustable trim tabs have proven to be an effective method for controlling the attitude of marine vessels, improvements to the systems used to control the tabs are needed. The Bennett et al U.S. Pat. No. 5,113,780, which discloses an automatic boat trim tab control device that includes electronic circuitry that is responsive to the removal of ignition power from the boat engine for causing the trim tabs to be fully retracted, provides one such improvement. The Bennett et al device serves as a safeguard against boat operator negligence by assuring that the tabs will be fully retracted before the boat is loaded onto a trailer or lifted by a fork lift, two situations where the tabs will likely incur damage if they are not fully retracted. It further reduces the area of the trim tab adjusting means that is left exposed to marine growth when the boat is stored in the water.

Despite the improvement provided by the Bennett et al device, the need for further improvements remains. One such need is for an automated control system that provides more hands-free adjustment of the tabs. During initial acceleration of the boat, it is frequently desirable to extend the tabs so as to prevent the bow from lifting out of the water. This prevents the propeller from riding too deep in the water and causes the forward thrust to be delivered more efficiently. However, moments after initial acceleration, it may become necessary to retract the tabs fully to prevent the bow from being driven into the water. Until now, to achieve trim tab retraction the operator has had to manually throw a tab adjusting switch for the duration necessary to achieve full tab retraction (approximately twenty seconds) for each tab that was extended. Typically, a vessel equipped with trim tabs has a port and starboard tab. Thus, to simultaneously retract the tabs requires the operator to simultaneously throw the respective tab adjusting switches for up to twenty seconds, thereby leaving the operator unable to simultaneously adjust steering and propulsion of the vessel. Such lack of control presents obvious potential hazards.

A second needed improvement is for a tab control system that would prevent damage to the trim tabs and maximize engine propulsion efficiency and control when the boat is propelled in the rearward direction, regardless of operator alertness. Until now, it has been up to the vessel operator to remember to retract the trim tabs before propelling the boat in reverse. Failure to do so will cause the tabs to encounter high water pressure in a manner not intended by their design. This hydraulic pressure will cause the trim tabs to act as a brake to the rearward propulsion of the boat, thereby impeding smooth navigation of the vessel in the rearward direction, as well as greatly detracting from engine efficiency. Furthermore, if the boat is propelled in the reverse direction with sufficient force, the hydraulic pressure encountered by the trim tabs may damage the tabs, the mechanical hardware affixing the tabs to the hull, the mechanical hardware used to adjust the orientation of the tabs, and/or the electrical circuitry used to activate the adjusting hardware.

Another needed improvement is for a tab control system that can be operated from locations on the boat remote from, and in addition to, the main control panel location. Such a system could allow boat passengers to be able to trim the vessel attitude, thereby freeing the boat operator to concentrate on more pressing navigational matters. Furthermore, such an improvement would provide the vessel operator with more versatility by enabling the operator to control the vessel attitude even when the operator is at locations in the boat remote from the control panel.

SUMMARY OF THE INVENTION

The above and other improvements to prior art trim tab control systems are provided by the present invention, which is an automated trim tab control system for use in conjunction with a trim tab adjusting system. A trim tab adjusting systems is used to trim the attitude of a motorized marine vessel by adjusting substantially planar tabs mounted to the rear of the hull of the vessel at, or below, the water line. The automated tab control system of the present invention serves as means to override the tab adjusting system and cause the trim tabs to be fully retracted more quickly and easily than manually retracting the tabs via the tab adjusting system, thereby providing the operator with greater hands-free control of the tabs. It should further be noted that the automated tab control system of the present invention functions independently of activation of the boat engine ignition switch.

The automated control system includes electrical control circuitry connectable to an electrical power source, such as the boat engine battery, in such a way that the power supplied by the power source to the circuitry of the present invention will be uninterrupted, regardless of whether the engine ignition switch is closed or open. The control circuit includes a capacitor capable of storing nearly the entire voltage supplied by the power source. A switch capable of being opened only momentarily is connected between the capacitor and the power source. During the period in which the switch is closed, the capacitor is charged and power is prevented from accessing the electromechanical portion of the automated circuit. Thus, the position of the tabs is not altered during this stage. In the preferred embodiment, a control button may be depressed to activate the switch, causing the switch to shift to its opened state for sufficient time to permit the charged capacitor to fully discharge. In an alternative embodiment, the switch is opened directly by an operator rather than being activated by a control button. Immediately after the passage of time necessary for the capacitor to fully discharge, the switch automatically returns to its normally-closed state, causing the capacitor to be recharged.

The power discharged by the capacitor is delivered to the electromechanical portion of the circuit, thereby causing the trim tabs to be fully retracted. In this way, means are provided which enable a vessel operator to cause all trim tabs to be simultaneously fully retracted by briefly depressing the control button or, alternatively, opening the switch rather than having to engage the adjusting switch for each trim tab for the duration of the retraction period.

The automated control circuitry of the present invention can also be made to communicate with vessel gear shift control means, such as a throttle, used to shift the engine into neutral, forward propulsion or rearward propulsion so that positioning the control means to cause the engine to be shifted into reverse will cause a switch in communication therewith to close. Closure of this switch connects a portion of the circuit of the present invention to ground so as to cause the capacitor to discharge in the same way as when the momentarily opening switch is opened, thereby causing the tabs to be automatically fully retracted. In this way, the automated control circuit serves as a safeguard against an operator who forgets to fully retract each tab manually before propelling the craft in the reverse direction, thereby reducing the potential for damage to the tabs while preventing unnecessarily rough and inefficient reverse navigation.

It should be noted that, because the capacitor is caused to discharge by the momentarily opening switch means independently of the reverse gear shift means, and vice versa, the device of the present invention will function when connected to either means singly, or to both means together.

As a further improvement to the prior art, the electrical control circuitry of the present invention is designed with protective means that will prevent damage to the circuitry if the control circuit is connected improperly. This protective means includes diodes located in the circuit at strategic points so as to prevent a flow of current in a direction that might result in damage to the components.

The present invention also provides means to adjust and/or automatically retract the tabs from multiple locations on the boat. In the preferred embodiment, this is accomplished by mounting tab adjusting switches connected to the tab adjusting system and/or control buttons in communication with the momentarily opening switch not only at the main control panel, but also at one or more other locations throughout the vessel. In an alternative embodiment, the plurality of control buttons is replaced by a plurality of momentarily opening switches connected in series in the automated circuit of the present invention.

The present invention further provides alternate means for activating the tab adjusting switches, control buttons, and/or momentarily opening switches, the alternate means being configured and positioned so as to enable the operator to easily activate the given switch or button by hand or by foot.

Objects of the Invention

It is therefore an object of the present invention to provide trim tab controlling means for trimming the attitude of a marine vessel, the controlling means automatically fully retracting the trim tabs when a switch is activated.

It is another object to provide automated controlling means that will automatically fully retract the tabs when the vessel engine is shifted so as to propel the boat in a rearward direction.

It is a another object to provide means for preventing damage to the trim tab control circuitry if it is installed incorrectly.

It is a further object to provide means by which the trim tabs can be automatically retracted and/or adjusted from multiple locations in the vessel, including at the main control panel.

It is still another object to provide trim tab control means that allow the vessel operator greater versatility in trimming the attitude of the boat.

It is a further object to provide trim tab control means that enable the operator to control the craft with greater hands-free operation.

It is yet another object to provide trim tab control means that permit a passenger to assist the vessel operator by enabling the passenger to adjust the attitude of the boat without interferring with the main controls of the vessel.

It is still another object to provide automated tab control means that reduce the potential for damage to the trim-tabs or boat.

It is a further object to provide automated tab control means that will assure smoother and more efficient navigation of a vessel when propelled in the rearward direction.

It is yet a further object to provide trim tab control means that are relatively simple and inexpensive to construct.

It is still another object to provide automated trim tab control means that are simple and trouble free to operate.

These and other objects and advantages of the present invention will become more apparent after consideration of the following specification taken in conjunction with the accompanying drawings wherein similar characters of reference refer to similar structures in each of the separate views.

BRIEF DESCRIPTION OF THE DRAWINGS

In the drawings that illustrate preferred embodiments of the invention.

BEST MODE FOR CARRYING OUT THE INVENTION

Figure 1:
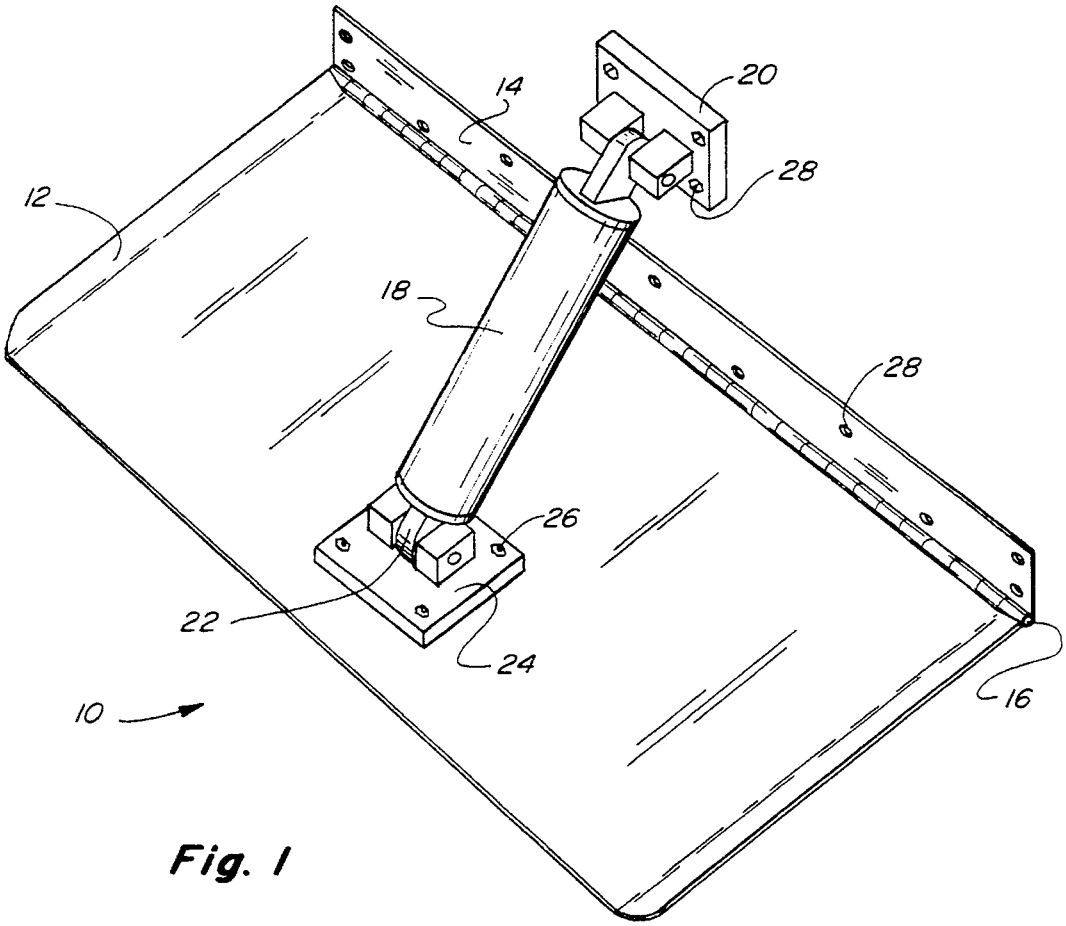
FIG. 1 is a perspective view of representative trim means.

Referring to FIG. 1, trim means 10 are shown including a tab 12 movably mounted to a backplate 14 by a hinge 16. An hydraulic actuator 18 has one end hingedly affixed to a mounting bracket 20. An actuator rod 22 telescopically retained within the walls of the hydraulic actuator 18 has one end hingedly affixed to a mounting plate 24. The mounting plate 24 is affixed to the tab 12 by a plurality of nut and bolt assemblies 26. By inserting the appropriate hardware (not shown) through a plurality of apertures 28 located in the backplate 14 and the mounting bracket 20, the mounting bracket 20 and backplate 14 of one or more trim means 10 can be mounted to the stern 30 of a hull 32 of a vessel 34, as shown in FIG. 2.

Figure 2:
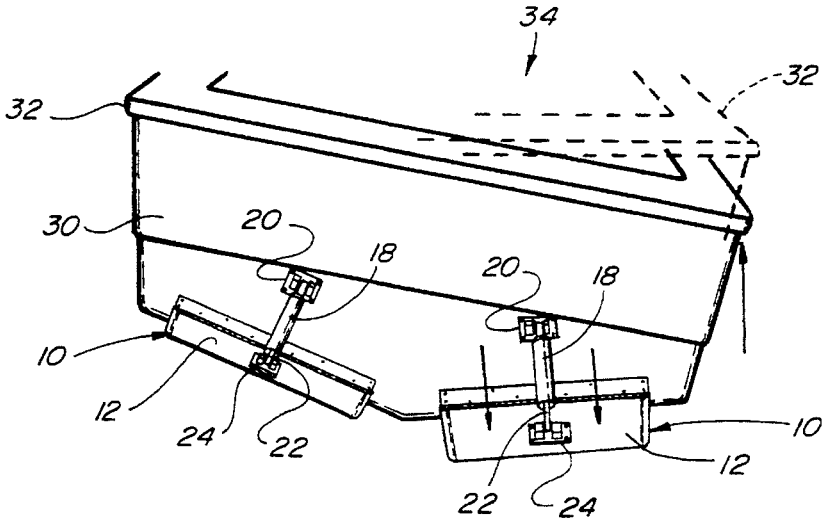
FIG. 2 is a perspective view of a pair of trim means shown mounted to the port and starboard sides of the stern of the hull of a boat.

As is also illustrated in FIG. 2, the actuator rods 22 can be adjusted to extend differing lengths relative to each other, thereby causing one tab 12, in this case the starboard tab 12, to be positioned lower in the water than the other tab 12. The lower that a tab 12 is positioned in the water, the greater the lift created by the tab 12. Consequently, when there is a disparity between tab depths, the side of the hull 32 corresponding to the tab 12 that is positioned lower in the water will ride higher in the water when the boat 34 is propelled forward. In this way, the trim means 10 can serve to turn the boat 34 more sharply, or level the craft 34 laterally when there is greater weight positioned on one side of the boat 34.

In contrast, when the actuator rods 22 are extended at equal lengths relative to each other, the trim means 10 adjust the craft 34 longitudinally rather than laterally. The deeper the tabs 12 are positioned in the water as the boat 34 is propelled forward, the greater the lift created at the stern 30, causing the bow to ride closer to the water surface than it otherwise would.

Finally, when the actuator rods 22 are in their fully retracted position, the tabs 12 have no effect on the lateral or longitudinal attitude of the vessel 34, and the boat 34 functions as it would without trim means 10. It can therefore be understood how the trim means 10 can be positioned to adjust the attitude of the boat 34 laterally, longitudinally or not at all.

Figure 3:
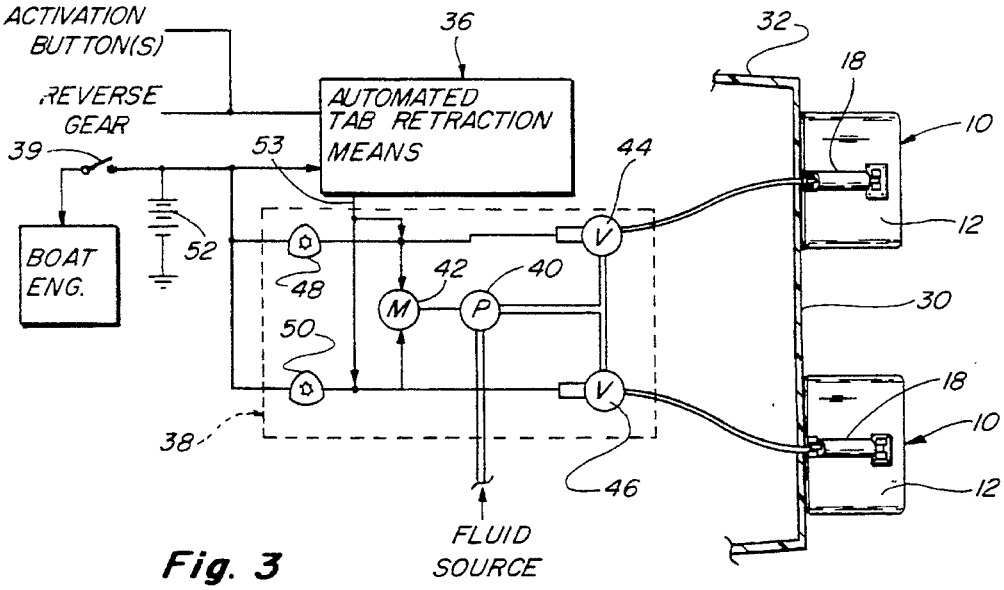
FIG. 3 is a functional block diagram of a power boat trim control system in accordance with a presently preferred embodiment of the invention.

FIG. 3 illustrates how automated trim control means 36 of the present invention are connected to, and interact with, prior art adjustable trim control means 38 to control the position of the trim means 10 independently of a boat engine ignition switch 39. The adjustable means 38 includes a fluid pump 40 powered by an electrical motor 42 for supplying hydraulic fluid under pressure from a fluid source to the hydraulic actuators 18, or from the actuators 18 to the fluid source, through respective solenoid-operated flow control valves 44 and 46. Three-position adjustment switches 48 and 50 are each connected between a battery 52 and a corresponding node connecting the given switch 48 or 50 to the motor 42 and the respective flow control valve 44 or 46. The three positions of the switches 48 and 50 enable an operator of the vessel 34 to either cause the motor 42 to operate the pump 40 so as to draw fluid away from the valves 44 and 46, thereby causing the tabs 12 corresponding to energized valves 44 and/or 46 to be lifted, cause the motor 42 to operate the pump 40 so as to force fluid toward the valves 44 and 46, thereby causing the tabs 12 corresponding to energized valves 44 and/or 46 to be lowered, or interrupt electrical control signals to the motor 42, thereby ceasing adjustment of the tabs 12 and maintaining them in their given position.

The automated tab retraction means 36 of the present invention are connected to receive direct current power from the battery 52 to selectively deliver an electrical control signal from its output terminal 53 simultaneously to the motor 42 and to both flow control valves 44 and 46, the motor 42 operating the pump 40 so as to draw fluid away from the valves 44 and 46.

It should be noted that the automated trim control means 36 can alternatively be functionally connected to prior art electro-mechanical adjustable trim control means (not shown), i.e., adjustable trim control means incorporating no hydraulic means and, instead, employing an electric motor associated with each actuator 18 to impart mechanical energy to the respective actuator rods 22.

Figure 4:
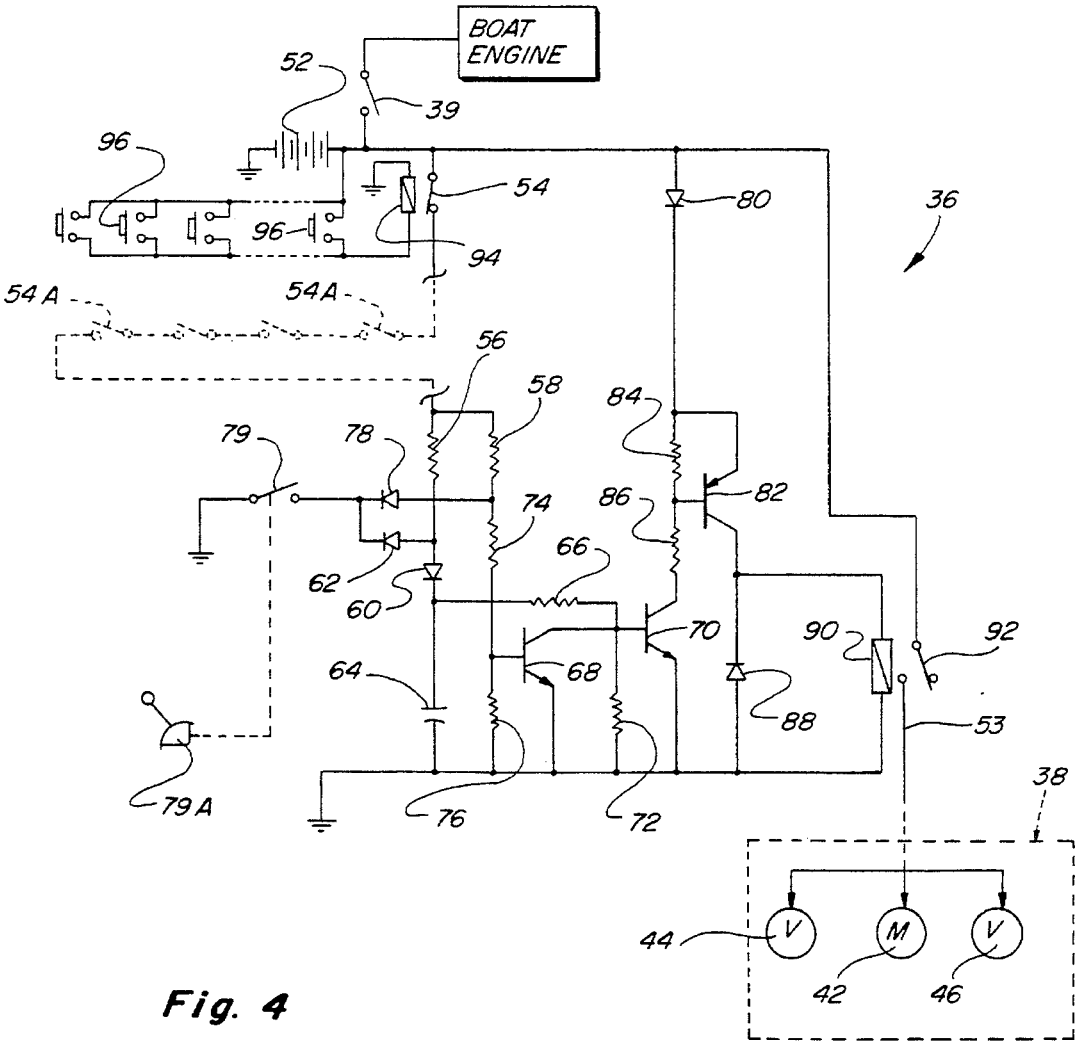
FIG. 4 is a schematic diagram of the control circuit of the present invention shown connected to a direct current power source independently of the engine ignition switch.

As illustrated in FIG. 4, the automatic retracting device 36 contains circuitry connected to the battery 52 to function independently of whether the engine ignition switch 39 is open or closed, and includes a momentarily opening switch 54 in a normally closed state connected between the battery 52 and one end of first and second resistors 56 and 58. The opposite end of the first resistor 56 is connected to the anodes of first and second diodes 60 and 62. A capacitor 64 is connected between the cathode of the first diode 60 and ground. A third resistor 66 has one end connected to the cathode of the first diode 60 and an opposite end connected to the collector of a first transistor 68 and the base of a second transistor 70. A fourth resistor 72 is connected between the node connecting the opposite end of the third resistor 66 and the collector of the first transistor 68 to the base of the second transistor 70, and ground. A fifth resistor 74 is connected between the opposite end of the second resistor 58 and the base of the first transistor 68. A sixth resistor 76 is connected between the base of the first transistor 68 and ground. A third diode 78 is also provided and has its anode connected to the opposite end of the second resistor 58 and its cathode .connected to the cathode of the second diode 62 and to a switch 79. When the switch 79 is closed, which occurs only when vessel gear shift controls 79A are adjusted to shift the engine into reverse gear, the cathodes of the second and third diodes 62 and 78 are connected to ground.

The emitters of the first and second transistors 68 and 70 are tied to ground. A fourth diode 80 has an anode connected to the battery 52 and a cathode connected to the collector of a third transistor 82. A seventh resistor 84 is connected between the collector and the base of the third transistor 82, while an eighth resistor 86 is connected between the base of the third transistor 82 and the collector of the second transistor 70. A fifth diode 88 has its cathode connected to the emitter of the third transistor 82 and its anode connected to ground. A first relay solenoid 90 connected in parallel with the fifth diode 88 controls the open/shut state of a relay contact 92 having one end connected to the battery 52. When the first relay solenoid 90 is energized, the relay contact 92 closes to the output terminal 53, and power from the battery 52 is allowed to pass through the automated retraction means 36 to energize the pump motor 42 and the flow control valves 44 and 46.

The switch 54 is normally closed, enabling battery power to pass through the first resistor 56 and first diode 60 to fully charge the capacitor 64. While the capacitor 64 remains charged, the three transistors 68, 70 and 82 function in conjunction with each other to prevent battery power from energizing the first solenoid 90, thereby holding the relay contact 92 in an open state and preventing battery power from passing through the automated means 36 to the motor 42 and to the valves 44 and 46.

In the preferred embodiment, the switch 54 is caused to momentarily open when a second relay solenoid 94 is energized by depressing any one of a plurality of parallel-connected switch buttons 96 located on the vessel 34. This causes the base of the first transistor 68 to be de-energized and the capacitor 64 to discharge by way of the base of the second transistor 70. This de-energizes the base of the third transistor 82, allowing current to flow from its emitter to energize the first relay solenoid 90. When the first solenoid 90 is energized, it causes the relay contact 92 to close, thereby enabling power from the battery 52 to be delivered across the output terminal 53 of the automated retraction means 36, simultaneously energizing the electric motor 42 and the valves 44 and 46 for sufficient duration to cause fluid to be completely evacuated from the hydraulic actuators 18 and, thus, cause the tabs 12 to retract to their fully retracted positions. Presently, the switch 54 will automatically return to its closed state, the capacitor 64 will recharge, and the three transistors 68, 70 and 82 will function to de-energize the first relay solenoid 90, causing the relay contact 92 to reopen and interrupt power from the battery 52 to the output 53 of the automatic retraction circuit 36. Therefore, by simply depressing one of the buttons 96, a vessel operator can cause the tabs 12 to be fully retracted simultaneously.

In an alternative embodiment, the plurality of buttons 96 is replaced by a plurality of momentarily opening switches 54A connected in series with the switch 54. Thus, when any one of the switches 54A or switch 54 is opened, the capacitor 64 discharges, causing a signal to be sent across the output terminal 53 to retract the tabs 12, as discussed above.

Similarly, adjusting the vessel gear shift controls 79A so as to shift the engine into reverse causes the switch 79 to close to ground, thereby de-energizing the base of the first transistor 68, allowing the capacitor 64 to discharge and, in short, causing the circuit of the automated means 36 to repeat the process described above. Thus, in the event that an operator forgets to retract the tabs 12 before propelling the vessel 34 in reverse, the tabs 12 will still be brought to their fully retracted position automatically.

It should be noted that the diodes 60, 62, 78, 80, and 88 not only serve to make the circuitry of the present invention function as it should when the circuitry is properly connected between the battery 52 and ground, they also serve as means to protect the other components of the circuitry from damage in the event that the circuit is improperly connected between the battery 52 and ground.

It should also be noted that control means (not shown) to operate the three-position switches 48 and 50, the buttons 96, and/or the momentarily opening switches 54A can be located in a plurality of locations throughout the vessel 34. Furthermore, the three-position switch control means, the buttons 96, and/or the switches 54A can be configured to provide greater ease for a boat operator or passenger to activate them by hand or by foot.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

What is claimed is:

1. A boat trim control system comprising:

a boat having a hull, an electrical power source, and an engine for powering the boat, trim means movably mounted to the hull for trimming the attitude of the boat as the hull is propelled through the water, adjusting means carried by the hull and responsive to a boat operator for selectively adjusting the position of the trim means to maintain the desired attitude under varying conditions, and automated means coupled to the trim means and to the electrical power source, the automated means including switch means operable when the boat is shifted to move rearwardly to automatically move the trim means to a predetermined position with respect to the hull when the engine is engaged to propel the hull in a rearward direction.

2. A trim tab control device for use on a boat having an engine with an ignition switch, the trim tab control device comprising:

trim means including trim tabs movably mountable to the rear of the boat near the water line for adjusting the attitude of the boat, adjusting means to be carried by the boat and coupled to the trim means for selectively adjusting the position of the trim tabs, and automated means to be coupled to an electrical power source carried by the boat so as to be electrically energizable independently of the condition of the ignition switch, the automated means being in operative communication with the trim means to enable automatically moving the trim tabs to a predetermined position when the automated means are electrically energized.

3. The device as described in claim 2 wherein the adjusting means include a plurality of switch means connected to the adjusting means and mountable in locations throughout the boat to permit adjusting the trim tabs from the locations.

4. The device as described in claim 2 wherein the trim means are hydraulically operated.

5. The device as described in claim 2 wherein the trim means are electro-mechanically operated.

6. Automated trim tab control means to be carried by a boat having a hull, trim means including at least one trim tab movably mounted at the stern of the hull, adjusting means attached to the trim means for controlling the position of the trim tab, an electrical power source, and engine ignition means, the automated trim tab control means comprising an electrical input terminal connectable to the electrical power source, an electrical output terminal connectable to the adjusting means so as to cause the adjusting means to cause the trim tab to be automatically moved to a predetermined position when electrical power is delivered from the electrical output terminal, and means functioning independently of the engine ignition means for controlling whether electrical power is delivered from the electrical output terminal.

7. Automated trim tab control means to be carried by a boat having a hull, trim means including at least one trim tab movably mounted near the stern of the hull, adjusting means attached to the trim means for controlling the position of the trim tab, an electrical power source, and engine ignition means, the automated trim tab control means comprising electrical circuitry having an input terminal for receiving electrical power when connected to the electrical power source, an output terminal to be connected to the adjusting means for delivering electrical power to the adjusting means to cause the adjusting means to move the trim tab to a predetermined position, capacitive means for storing the electrical power received from the electrical power source so as to prevent electrical power from reaching the output terminal, and control means functioning independently of the engine ignition means for isolating the electrical power source from the capacitive means, thereby causing the capacitor to discharge and deliver electrical energy to the output terminal.

8. The device as described in claim 7 wherein the automated trim tab control means include a momentarily opening switch connected between the electrical power source and the capacitive means, the closed state of the switch causing the capacitive means to be in electrical communication with the electrical power source, and the open state of the switch electrically isolating the capacitive means from the electrical power source.

9. In a boat having ignition means, a source of electrical energy, a rear end panel with trim tabs hingedly mounted thereon and movable between a retracted upward position and an extended downward position, and extendable and retractable means connected between the rear end panel and the trim tabs energizable to control the position thereof, the improvement comprising circuit means independent of the ignition means including means operatively connected to the extendable and retractable means to control the operation thereof and the position of the trim tabs, said circuit means including a capacitor and switch means in series therewith connected to the energy source, the capacitor establishing a charge whenever the switch means are closed, and means when the switch means are open to discharge the capacitor, said last named means including means to energize the extendable and retractable means in a direction to retract the trim tabs.

10. In the boat of claim 9 wherein means are provided to open the circuit of the switch means whenever the controls for the boat are set to propel the boat in a rearward direction.

11. In a boat having ignition means, a source of electrical energy, a rear end panel with trim tabs hingedly mounted thereon and movable between a retracted upward position and an extended downward position, and extendable and retractable means connected between the rear end panel and the trim tabs energizable to control the position thereof, the improvement comprising circuit means independent of the ignition means including means operatively connected to the extendable and retractable means to control the operation thereof and the position of the trim tabs, said circuit means including a capacitor and switch means in series therewith connected to the ground, the capacitor establishing a charge whenever the switch means are open, and means when the switch means are closed to discharge the capacitor, said last named means including means to energize the extendable and retractable means in a direction to retract the trim tabs.

12. In the boat of claim 11 wherein means are provided to close the switch means whenever the controls for the boat are set to propel the boat in a rearward direction.

13. A trim tab control device for use on a boat having an engine, the trim tab control device comprising:

trim means including trim tabs movably mountable to the rear of the boat near the water line for adjusting the attitude of the boat, adjusting means to be carried by the boat and coupled to the trim means for selectively adjusting the position of the trim tabs, and automated means to be coupled to an electrical power source carried by the boat so as to be electrically energizable independently of the boat engine, the automated means being in electrical communication with the trim means to enable automatically moving the trim tabs to a predetermined position when the automated means are electrically energized the automated means being in electro-mechanical communication with engine gear shift control means having a reverse gear, the automated means being electrically energized when the engine gear shift control means are shifted into reverse gear.

14. Automated trim tab control means to be carried by a boat having a hull, trim means including at least one trim tab movable mounted at the stern of the hull, adjusting means attached to the trim means for controlling the position of the trim tab, an electrical power source, and engine ignition means, the automated trim tab control means comprising an electrical input terminal connectable to the electrical power source, an electrical output terminal connectable to the adjusting means so as to cause the adjusting means to cause the trim tab to be automatically moved to a predetermined position when electrical power is delivered from the electrical output terminal, and means functioning independently of the engine ignition means for controlling whether electrical power is delivered from the electrical output terminal the automated means being in electro-mechanical communication with engine gear shift control means having a reverse gear, the automated means being caused to deliver electrical power across the output terminal when the engine gear shift control means are shined into reverse gear.

15. Automated trim tab control means to be carried by a boat having a hull, trim means including at least one trim tab movable mounted at the stern of the hull, adjusting means attached to the trim means for controlling the position of the trim tab, an electrical power source, and engine ignition means, the automated trim tab control means comprising electrical circuitry having an input terminal for receiving electrical power when connected to the electrical power source, an output terminal to be connected to the adjusting means for delivering electrical power to be connected to the adjusting means for delivering electrical power to the adjusting means to cause the adjusting means to move the trim tab to a predetermined position, capacitive means for storing the electrical power received from the electrical power source so as to prevent electrical power from reaching the output terminal, and control means functioning independently of the engine ignition means for isolating the electrical power source from the capacitive means, thereby causing the capacitor to discharge and deliver electrical energy to the output terminal the control means including engine gear shift control means having a position corresponding to reverse gear, the last-named means being in electro-mechanical communication with the automated trim tab control means so that the capacitive means is caused to discharge and deliver electrical power across the output terminal when the engine gear shift control means are shifted into the position corresponding to reverse gear.

16. A trim tab control device for use on a boat having an engine, the trim tab control device comprising:

trim means including trim tabs movably mountable to the rear of the boat near the water line for adjusting the attitude of the boat, adjusting means to be carried by the boat and coupled to the trim means for selectively adjusting the position of the trim tabs, and automated means to be coupled to an electrical power source carried by the boat so as to be electrically energizable independently of the boat engine, the automated means being in electrical communication with the trim means to enable automatically moving the trim tabs to a predetermined position when the automated means are electrically energized, the automated means including a capacitor and a momentarily opening switch connected between the electrical power source and the capacitor, the closed state of the switch causing the capacitor to be in operative communication with the electrical power source, and the open state of the switch electrically isolating the capacitor from the electrical power source.

17. The device as described in claim 16 wherein the automated means automatically move the trim means to a predetermined position with respect to the hull when the momentarily opening switch is opened.

18. The device as described in claim 17 wherein multiple momentarily opening switches are connected in series and mounted at various locations in the boat.

19. The device as described in claim 16 wherein a solenoid causes the momentarily opening switch to open when a control button in electrical communication with the solenoid is positioned to energize the solenoid.

20. The device as described in claim 19 wherein multiple control buttons are mounted at various locations in the boat.

21. A trim tab control system for use in connection with a boat having a hull and an engine connected to a power source, the boat further having trim tabs mounted to the boat hull and configured for trimming the attitude of the boat as the hull is propelled through the water, said trim tab control system comprising:

an automatic retraction unit coupled to the trim tabs and to the electrical power source, said retraction unit being operable to cause the trim tabs to move to a predetermined position with respect to the hull when the engine is engaged to propel the hull in a rearward direction.

22. A trim tab control system in accordance with claim 21 further comprising a trim tab attitude adjustment unit responsive to a boat operator for selectively adjusting the position of the trim tabs, said trim tab attitude adjustment unit being configured to be coupled to an output of said retraction unit.

23. A trim tab control system in accordance with claim 22 wherein said trim tab attitude adjustment unit is configured to move the trim tabs to the predetermined position when the output is generated by said retraction unit.

24. A trim tab control system in accordance with claim 22 wherein said trim tab attitude adjustment unit is configured to be electrically energizable independently of the engine.

25. A trim tab control system in accordance with claim 21 wherein said control system further comprises a switch coupled to the electrical power source and said retraction unit, said switch having a first position and a second position, said retraction unit being configured to be responsive said switch so that when said switch is disposed in the second position, said retraction unit is operable to cause the trim tabs to move to the predetermined position.

26. A trim tab control system in accordance with claim 21 wherein said control system further comprises a plurality of operator controlled switches coupled to said retraction unit, said retraction unit being responsive to each of said switches so that when any one of said switches is disposed in a predetermined state, said retraction unit is operable to cause the trim tabs to move to the predetermined position.

27. A trim tab control system in accordance with claim 21 wherein the predetermined position is one in which the trim tabs are at least partially retracted from a fully extended position.

* * * * *

UNITED STATES PATENT AND TRADEMARK OFFICE

CERTIFICATE OF CORRECTION

PATENT NO. : 5,474,013
DATED : December 12, 1995
INVENTOR(S) : Edward A. Wittmaier It is certified that error appears in the above-indentified patent and that said Letters Patent is hereby corrected as shown below:

Column 6, line 25, delete "." before --connected--.

Column 10, line 12, "shined" should be --shifted--.

Signed and Sealed this

Twenty-sixth Day of March, 1996

*Attest:*

*Attesting Officer*

BRUCE LEHMAN

*Commissioner of Patents and Trademarks*